US007915829B2

(12) United States Patent
Keller et al.

(10) Patent No.: US 7,915,829 B2
(45) Date of Patent: Mar. 29, 2011

(54) REMOTELY MONITORED AND CONTROLLED DISTRIBUTED EMERGENCY POWER SYSTEM

(75) Inventors: Scott Keller, Still River, MA (US); Alfred Hamilton, Southborough, MA (US)

(73) Assignee: Signal Fire, Still River, MA (US)

( * ) Notice: Subject to any disclaimer, the term of this patent is extended or adjusted under 35 U.S.C. 154(b) by 556 days.

(21) Appl. No.: 12/050,149

(22) Filed: Mar. 17, 2008

(65) Prior Publication Data

US 2008/0224617 A1 Sep. 18, 2008

Related U.S. Application Data

(60) Provisional application No. 60/895,469, filed on Mar. 18, 2007.

(51) Int. Cl.
*H05B 37/00* (2006.01)

(52) U.S. Cl. ..... 315/86; 315/312; 315/362; 315/360; 315/156; 455/92; 455/404.1; 340/693.2

(58) Field of Classification Search ..... 315/86, 315/149, 156, 159, 291, 312, 307, 360, 362; 455/68, 69, 90.1, 92, 343.1, 343.6, 404.1, 455/571–574; 340/693.1–693.4, 945, 956, 340/572.7, 539.16, 539.17

See application file for complete search history.

(56) References Cited

U.S. PATENT DOCUMENTS

| | | | | |
|---|---|---|---|---|
| 4,977,351 | A * | 12/1990 | Bavaro et al. | 315/87 |
| 6,329,907 | B1 * | 12/2001 | Uischner et al. | 340/333 |
| 6,427,072 | B1 * | 7/2002 | Reichelt | 455/404.1 |
| 6,502,044 | B1 * | 12/2002 | Lane et al. | 702/63 |
| 6,710,546 | B2 * | 3/2004 | Crenshaw | 315/86 |
| 7,342,513 | B2 * | 3/2008 | Meyer | 340/945 |
| 7,496,445 | B2 * | 2/2009 | Mohsini et al. | 701/206 |

* cited by examiner

*Primary Examiner* — Haissa Philogene
(74) *Attorney, Agent, or Firm* — Kurt Rauschenbach; Rauschenbach Patent Law Group, LLP

(57) ABSTRACT

An emergency lighting system includes a plurality of emergency lights and a plurality of emergency power systems. Each of the plurality of emergency power systems is electrically connected to a respective one of the plurality of emergency lights through a respective one of a plurality of power switches. The emergency lighting system also includes a plurality of processors. Each of the plurality of processors is electrically connected to a respective one of the plurality of emergency power systems and executes software that monitors a status of a respective one of the emergency power systems and controls a state of the plurality of power switches. The emergency lighting system also includes a plurality of radio transceivers. Each of the plurality of radio transceivers is electrically connected to a respective one of the plurality of processors and communicates with other radio transceivers in the plurality of radio transceivers that are in radio wave proximity. In addition, a gateway node radio transceiver routes signals to and from the plurality of radio transceivers.

12 Claims, 4 Drawing Sheets

REMOTELY MONITORED AND CONTROLLED DISTRIBUTED EMERGENCY POWER SYSTEM

RELATED APPLICATION SECTION

This application claims priority to U.S. Provisional Patent Application Ser. No. 60/895,469, filed Mar. 18, 2007, entitled "Remotely Monitored and Controlled Distributed Emergency Power System." The entire specification of U.S. Provisional Patent Application Ser. No. 60/895,469 is incorporated herein by reference.

BACKGROUND OF THE INVENTION

The present invention relates to the field of remotely monitoring and controlling a distributed emergency power system. In distributed emergency power units, the main line AC power charges a backup power system, which is typically a battery, but can be any type of energy storage system. In some embodiments, the distributed emergency power units also supply power the load. In other embodiments, the distributed emergency power units do not supply power the load. If the main line AC power is lost, the load is then powered from the backup power system until main AC power is restored or the backup power supply is exhausted.

In order to make sure that battery powered emergency systems are capable of supplying power when necessary, standard functionality tests are performed at regular intervals. These tests may include simple operability tests or more complex tests that determine if the system is capable of performing according to some or all of its full performance specification. For example, simple operability tests of battery powered emergency systems for the lighting industry are often performed at intervals of 30 days. More complete tests of the battery powered emergency systems full specifications are performed at longer intervals, such as quarterly or yearly intervals.

Known distributed emergency power systems are manually tested. These systems usually include a switch that is physically located on the system that will initiate a test or a testing sequence. An indicator, such as a LED or an audible alarm, which is also physically located on the system, is used to alert the operator of the test results. Thus, in known distributed emergency power systems, testing is labor intensive. The testing in these known systems is also subject to human error, so regular testing is not always performed and the results are sometimes misunderstood or not properly recorded. Some state-of-the art distributed emergency power systems perform tests automatically. However, in these state-of-the art systems, an operator must still observer some indicator, such as an LED or alarm, to determine if the test was successful or if a failure has occurred.

SUMMARY OF THE INVENTION

An emergency lighting system is disclosed that includes a plurality of emergency lights, a plurality of emergency power systems, a plurality of processors, a plurality of radio transceivers, and a gateway radio transceiver. Each of the plurality of emergency power systems is electrically connected to a respective one of the plurality of emergency lights through a respective one of a plurality of power switches. Each of the plurality of processors is electrically connected to a respective one of the plurality of emergency power systems. Each of the plurality of processors executes software that monitors a status of a respective one of the emergency power systems and controls a state of a respective one of the plurality of power switches. Each of the plurality of radio transceivers is electrically connected to a respective one of the plurality of processors. Each of the plurality of radio transceivers communicates with other radio transceivers in the plurality of radio transceivers that are in radio wave proximity. The gateway radio transceiver receives signals from and routes signals to the plurality of radio transceivers.

BRIEF DESCRIPTION OF THE DRAWINGS

The aspects of this invention may be better understood by referring to the following description in conjunction with the accompanying drawings. Identical or similar elements in these figures may be designated by the same reference numerals. Detailed description about these similar elements may not be repeated. The drawings are not necessarily to scale. The skilled artisan will understand that the drawings, described below, are for illustration purposes only. The drawings are not intended to limit the scope of the present teachings in any way.

DETAILED DESCRIPTION

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

While the present teachings are described in conjunction with various embodiments and examples, it is not intended that the present teachings be limited to such embodiments. On the contrary, the present teachings encompass various alternatives, modifications and equivalents, as will be appreciated by those of skill in the art. In particular, while some aspects of the present invention are described in connection with emergency lighting systems, it should be understood that the present invention can be used in connection with numerous types of distributed power units and distributed emergency power units. Also, it should be understood that that present invention is not limited to use with emergency power units.

It should be understood that the individual steps of the methods of the present invention may be performed in any order and/or simultaneously as long as the invention remains operable. Furthermore, it should be understood that the apparatus and methods of the present invention can include any number or all of the described embodiments as long as the invention remains operable.

In many embodiments, a distributed emergency power system according to the present invention includes an energy source, such as a backup power system. The backup power system can be any type of energy storage device, such as a battery. A charging circuit, such as a battery charger is used to charge the energy storage device. The distributed emergency power system also includes a load which may or may not be activated when AC power is present. In addition, the distributed emergency power system includes an AC power detection and switching circuit that detects a failure in AC power and switches the energy source to the load, thereby providing emergency power to the load.

In one specific embodiment of the present invention, the distributed emergency power system is a network of emergency lighting devices. The network of emergency lighting devices includes a plurality of emergency power system. Each of the plurality of emergency power system includes a radio system having a transceiver and processor. A gateway radio transceiver receives signals from and routes signals to the radio transceivers.

Figure 1:
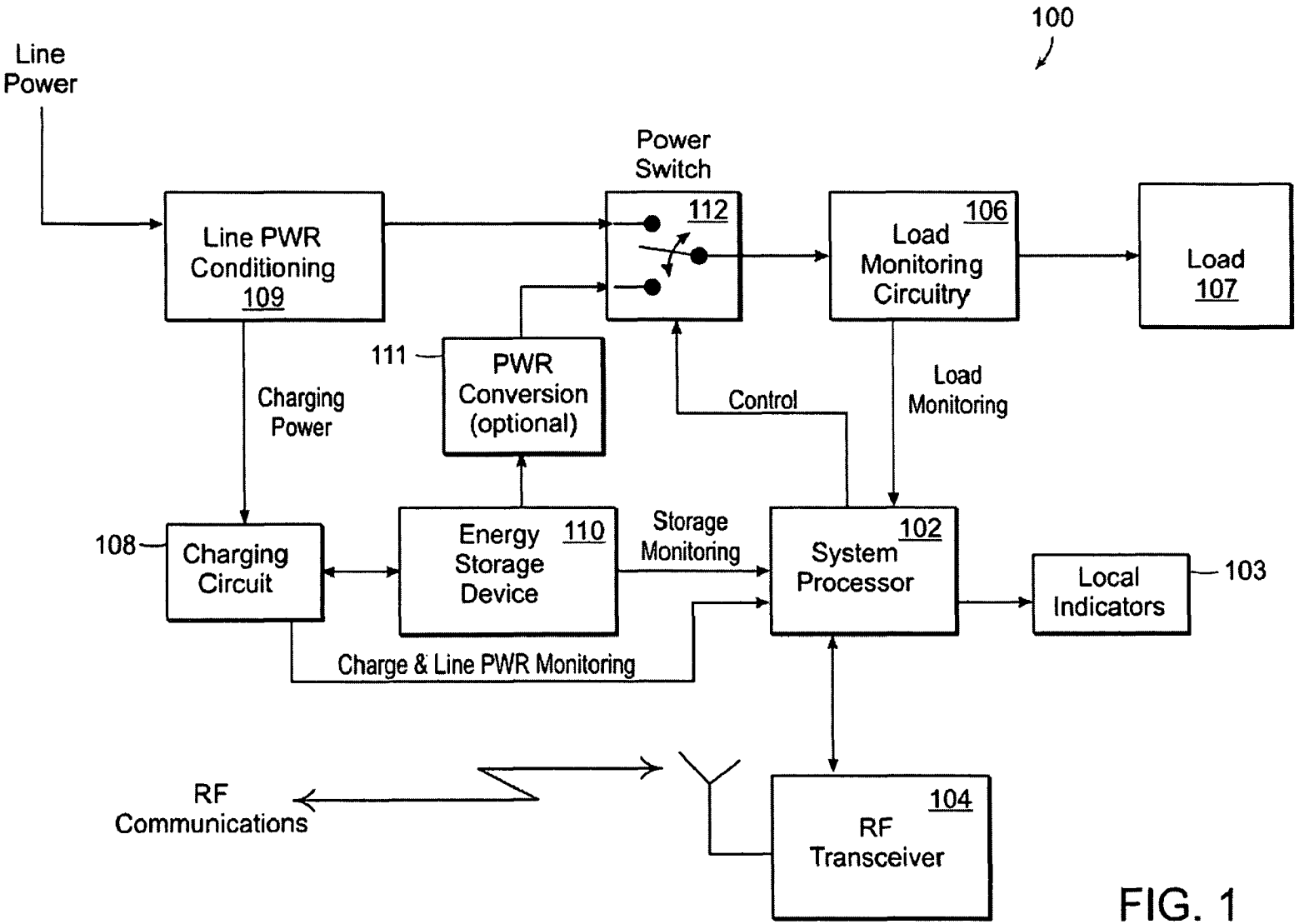
FIG. 1 illustrates one embodiment of an emergency power system with an integrated system processor and a RF transceiver according to the present invention.

FIG. 1 illustrates one embodiment of an emergency power system 100 with an integrated system processor 102 and a RF transceiver 104 according to the present invention. The system processor 102 is electrically connected to local indicators 103, such as indicator lights or a video display terminal that indicates the status of the emergency power system 100.

The system processor 102 is electrically connected to a load monitoring circuit 106. The load monitoring circuit 106 generates a signal that indicates the power delivered to the load 107. The system processor 102 receives the signal. The system processor 102 is also electrically connected to a control input of a power switch 112. The power switch 112 selects one of AC line power and an alternative or emergency power source, such as the energy storage device 110 and then applies the AC line power to the load 107.

The system processor 102 generates a signal that instructs the power switch 112 to change from one of the AC line (or the AC line conditioning circuit 109) and the energy storage device 110 to the other of the AC line (or the AC line conditioning circuit 109) and the energy storage device 110. In some embodiments, a power conversion circuit 111 is used to convert the power from the energy storage device 110 to a power that is suitable to drive the load 107. For example, the power conversion circuit 111 can be an inverter that converts DC power from a DC energy storage device, such as a battery, to AC power.

The system processor 102 is also electrically connected to a charging circuit 108. The charging circuit 108 is directly coupled to the AC line or to the AC line conditioning circuit 109 that cleans the power delivered to the load 107. The charging circuit 108 charges an energy storage device 110. A system processor 102 is also electrically connected to an output of the energy storage device 110. The system processor 102 determines information, such as the energy capacity of the energy storage device 110 and, consequently, when the charging circuit 108 is activated and deactivated.

In many embodiments, the integrated wireless message forwarding network including the system processor 102 and the RF transceiver 104 forms a bi-directional network that provides the operator with various monitoring and control functionality through the local indicators 103 and remote indicators and terminals via the RF transceiver. For example, the system processor 102 and the RF transceiver 104 can provide the operator with energy storage information from the energy storage device 110, charging voltage monitoring information from the charging circuit 108, and load 107 status monitoring from the load monitoring circuit 106.

Load status monitoring can be used to determine if the load 107 is activated or deactivated and/or if the load 107 is working properly. Also, the system processor 102 can perform load testing and can activate or deactivate loads. In one embodiment, the results of the various tests and/or instructions given to the system processor 102 are stored or transmitted via the RF transceiver 104 to a centralized database. Such a central database is typically stored on a computer that controls the emergency power system through the system processor 102.

Figure 2:
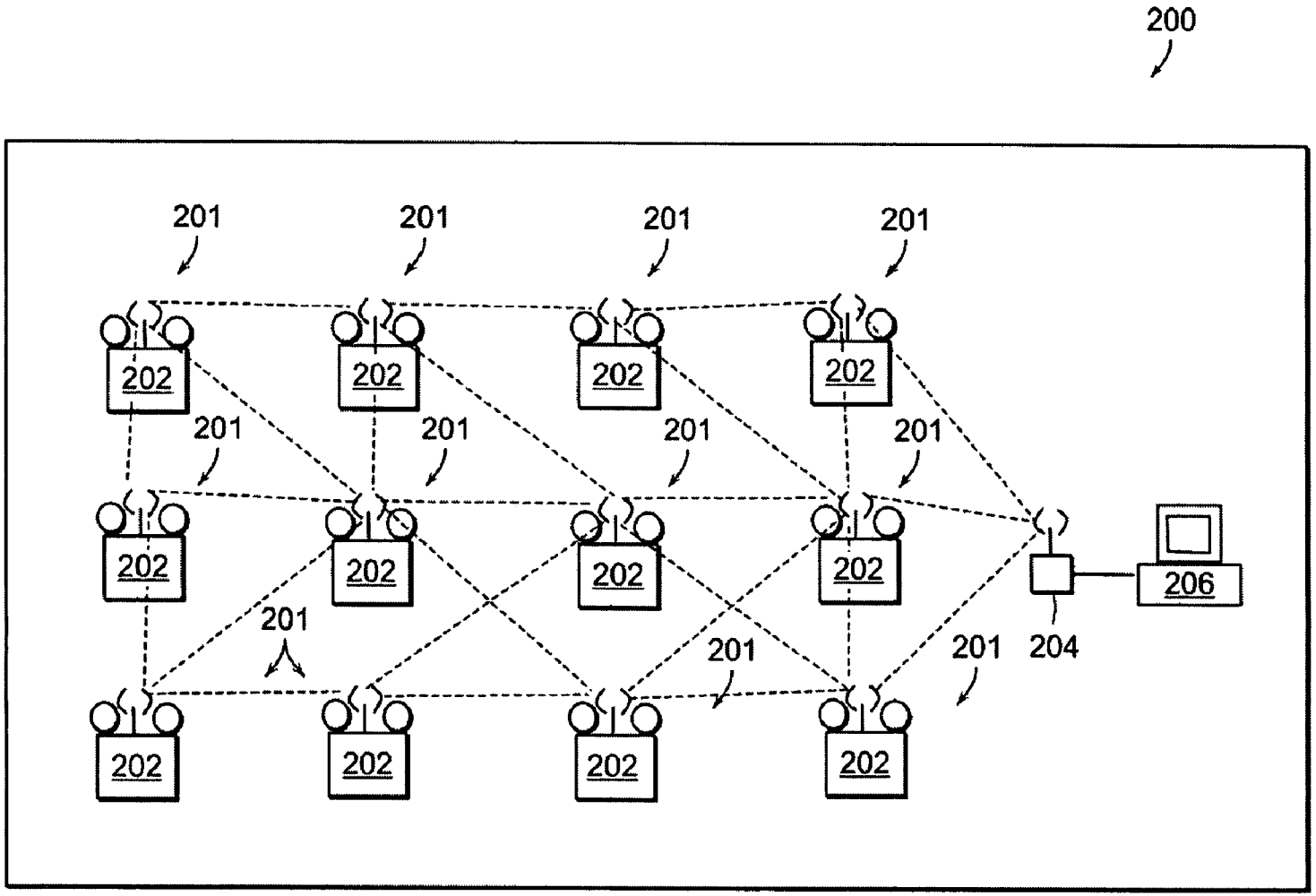
FIG. 2 illustrates various system level components of an emergency lighting system according to the present invention that includes a wireless message forwarding network.

FIG. 2 illustrates various system level components of an emergency lighting system 200 according to the present invention that includes a wireless message forwarding network. The emergency lighting system 200 includes a plurality of emergency lights 201 and a plurality of device nodes 202. Each of the plurality of emergency lights 201 is electrically connected to a respective one of a plurality of device nodes 202. Each of the plurality of device nodes 202 is an independent device node that can perform tasks independent of other device nodes.

Each of the plurality of device nodes 202 includes an emergency power system. In addition, each of the plurality of device nodes 202 includes a processor that executes monitoring and control software, and memory, such as RAM and ROM. The processors execute an application program that monitors and controls the emergency lighting system 200 and its load. In some embodiments, device nodes 202 interface with a sensor and/or an actuator.

In addition, each of the plurality of device nodes 202 also includes a radio transceiver that allows each of the plurality of device node 202 to communicate with other device nodes in the plurality of device nodes 202 that are in radio wave proximity. In some embodiments, the radio transceivers are software defined radio transceivers that send and receive data in packets. Such transceivers are well known in the art.

The emergency lighting system 200 also includes a gateway node 204 that is a terminal node. The gateway node 204 is a stand-alone radio that serves as the destination for inbound messages and the origin for outbound messages. In some embodiments, the gateway node 204 is electrically connected to a computer using a serial, USB, Ethernet, or other interface. All messages are either routed to the gateway node 204 or originate at the gateway node 204. In some embodiments, the gateway node 204 is directly connected to a hard wired network, such as the internet, a wireless network, a cellular network, or other type of data communications network.

The computer 206 executes monitoring and control software. The monitoring and control software is designed to permit an operator to monitor the status of the individual device nodes. Also, the monitoring and control software is designed to send instructions to a device node or nodes to run remote tests and diagnostics or to actuate a load on some or all of the individual device nodes. In some embodiments, monitoring and control software stores historical data about the status of some or all of the plurality of nodes 202.

In operation, each of the plurality of device nodes 202 performs various functions, such as monitoring the status of the emergency lighting system 200, creating status messages for the operator, receiving commands from the operator, and performing actions based on the commands received from the operator. Also, each of the plurality of device nodes 202 communicate in a network of devices that transmits messages toward the gateway node 204 and that receives messages from the gateway node 204 and from particular device nodes in the plurality of device nodes 202. Data is sent from an originating node to a destination node either directly or through intermediary nodes according to various software algorithms. One aspect of the emergency lighting system 200 is that the wireless message forwarding network can be self-forming and self-healing. In addition, particular device nodes in the plurality of device nodes 202 can have the capability of using several methods of forwarding messages through the network in order to obtain the desired performance.

Figure 3:
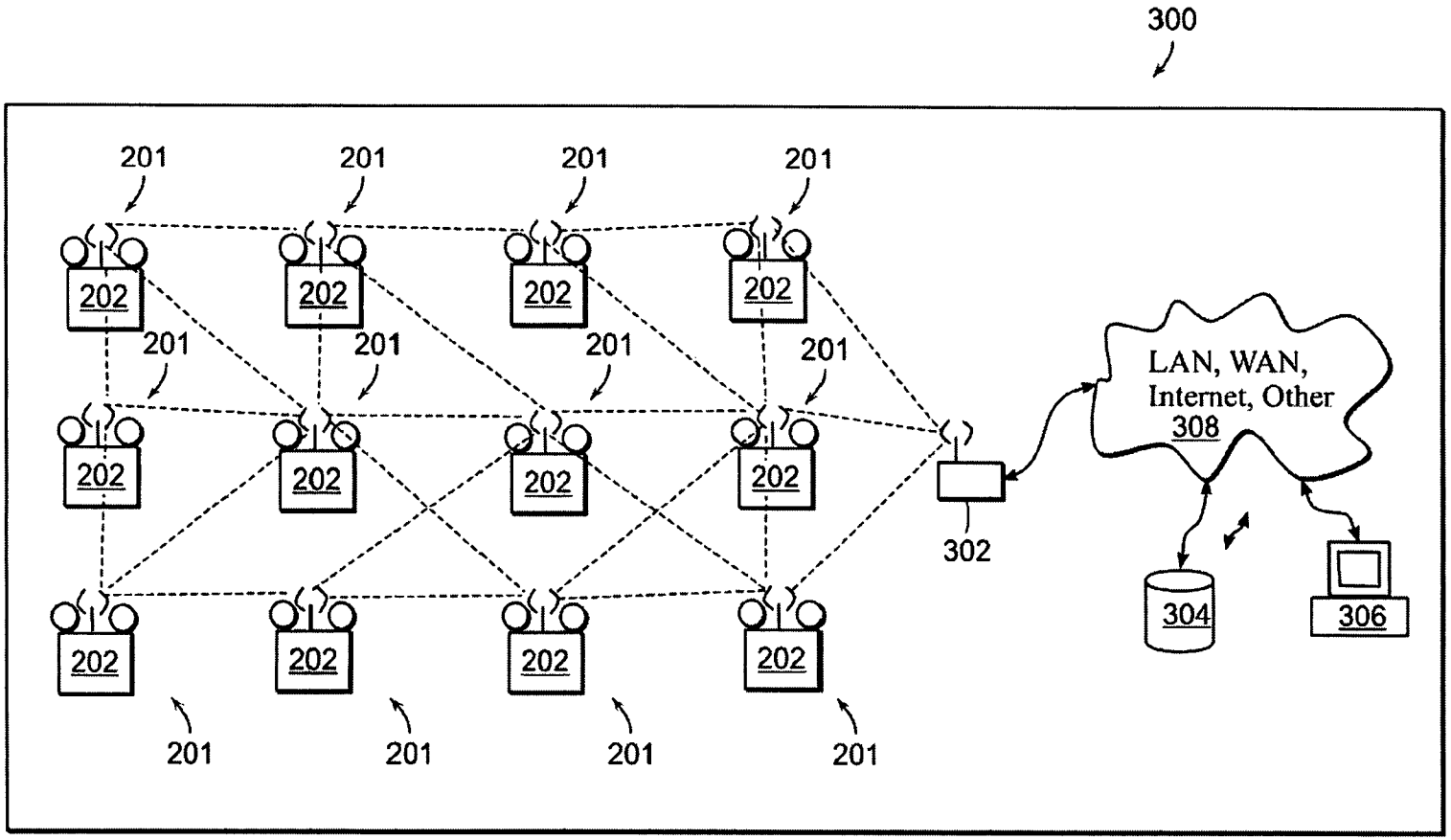
FIG. 3 illustrates various system level components in a remote monitored emergency lighting system according to the present invention.

FIG. 3 illustrates various system level components in a remote monitored emergency lighting system 300 according to the present invention. The remote monitored emergency lighting system 300 is similar to the emergency lighting system 200 described in connection with FIG. 2. However, the remote monitored emergency lighting system 300 uses a gateway system 302 and a remote data server 304 instead of a local monitoring system as described in connection with FIG. 2. The remote data server 304 communicates with a computer 306 over a network 308. One skilled in the art will appreciate that the remote data server 304 can communicate with the computer 306 over numerous types of networks, such as local area networks, wide area networks, the internet, and any type of wireless network including cellular networks.

Figure 4:
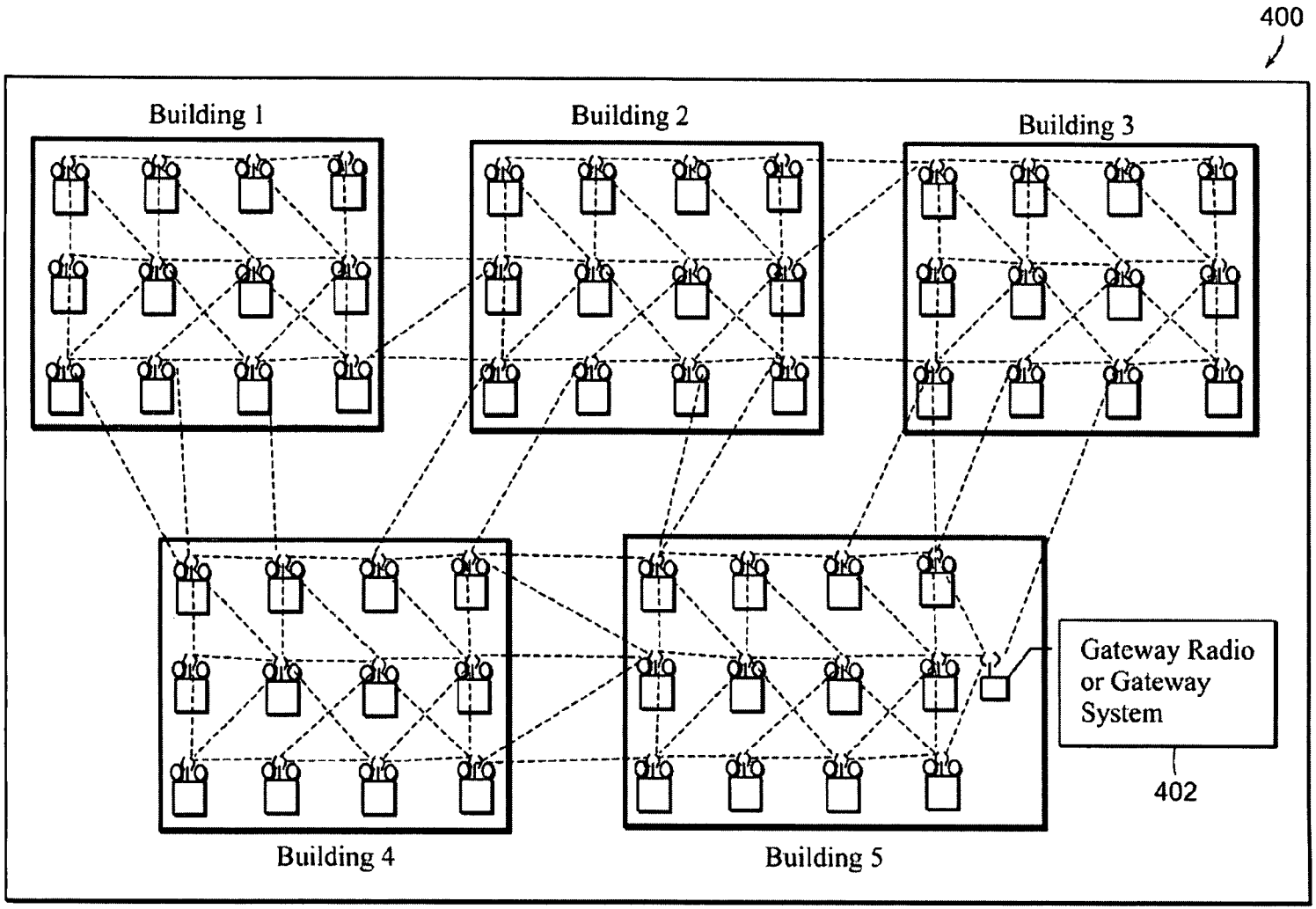
FIG. 4 illustrates a remotely monitored emergency lighting system according to the present invention that is deployed in a plurality of buildings.

FIG. 4 illustrates a remotely monitored emergency lighting system 400 according to the present invention that is deployed in a plurality of buildings. In this embodiment of the invention, the gateway 402 is a radio gateway system 402. For example, the gateway 402 can be a node radio with an integrated processor (or other computing device) and a memory device. The radio gateway system 402 with the integrated processor is also capable of forwarding information to and receiving information from a remote location over various types of networks. For example, the radio gateway system 402 can forward and receive data over the internet, a wide area network, a local area network, and/or any type of wireless network including cellular networks. A remote data server stores and processes data sent to and from the gateway system 402.

In some embodiments of the present invention, the remote monitored emergency lighting system 400 also includes a monitoring and control portal that interfaces with the remote data server. The monitoring and control portal can be implemented in software or can be implemented at a console. The monitoring and control portal can be directly interfaced to the remote data server or can be interfaced through a network, such as the internet, a wide area network, a local area network, and a cellular network.

There are many applications of the present invention. In one specific application, an emergency lighting system according to the present invention is used in at least some building of a campus or office park. At least some of the buildings include nodes that are monitored and controlled by the emergency lighting system as described herein.

Remotely monitored emergency lighting system according to the present invention can preform many functions that are not possible with prior art systems. For example, a remotely monitored emergency lighting system according to the present can provide an operator with the ability to activate and deactivate particular emergency lights in the system. Such a capability is important for many situations, such as aiding law enforcement and emergency workers.

In addition, a remotely monitored emergency lighting system according to the present can be used in conjunction with various types of sensors, such as smoke, temperature, and nuclear biological chemical (NBC) sensors. These sensors can be monitored and can be connected to emergency power sources with the remotely monitored emergency lighting system of the present invention.

Furthermore, the remotely monitored emergency lighting system according to the present can greatly reduce maintenance costs compared with conventional emergency lighting systems. Systems according to the present invention can allow the operator to replace batteries or other emergency power source only when necessary instead or performing routine maintenance.

In addition, remotely monitored emergency lighting systems according to the present invention can allow an operator, or can enable a computer program, to predict when an emergency power source failure will occur. Similarly, remotely monitored emergency lighting systems according to the present invention can be used to test emergency lighting source bulbs and to predict when they need to be replaced based upon electrical measurements.

EQUIVALENTS

While the present teachings are described in conjunction with various embodiments and examples, it is not intended that the present teachings be limited to such embodiments. On the contrary, the present teachings encompass various alternatives, modifications and equivalents, as will be appreciated by those of skill in the art, may be made therein without departing from the spirit and scope.

What is claimed is:

1. An emergency lighting system comprising:

a. a plurality of emergency lights;

b. a plurality of emergency power systems, each of the plurality of emergency power systems being electrically connected to a respective one of the plurality of emergency lights through a respective one of a plurality of power switches;

c. a plurality of processors, each of the plurality of processors being electrically connected to a respective one of the plurality of emergency power systems and executing software that monitors a status of a respective one of the emergency power systems and controls a state of a respective one of the plurality of power switches;

d. a plurality of radio transceivers, each of the plurality of radio transceivers being electrically connected to a respective one of the plurality of processors and communicating with other radio transceivers in the plurality of radio transceivers that are in radio wave proximity; and e. a gateway radio transceiver that receives signals from and routes signals to the plurality of radio transceivers.

2. The emergency lighting system of claim 1 wherein the plurality of emergency power systems comprises a plurality of batteries.

3. The emergency lighting system of claim 1 further comprising a computer that is electrically connected to the gateway radio transceiver.

4. The emergency lighting system of claim 3 wherein the computer stores signals from the plurality of processors in a database.

5. The emergency lighting system of claim 1 wherein at least one of the plurality of processors is electrically connected to a computer that stores a status of a respective one of the plurality of emergency power systems.

6. The emergency lighting system of claim 1 wherein the plurality of processors instruct the plurality of power switches to connect respective ones of the plurality of emergency power systems to respective ones of the plurality of emergency power systems.

7. The emergency lighting system of claim 1 wherein at least one of the plurality of processors is electrically connected to an indicator that indicates a status of a respective one of the plurality of emergency power systems.

8. The emergency lighting system of claim 1 wherein the gateway radio transceiver is electrically connected to a network.

9. The emergency lighting system of claim 1 wherein the gateway radio transceiver is in radio communication with a wireless wide area network.

10. The emergency lighting system of claim 1 wherein the gateway radio transceiver is in radio communication with a remote server.

11. An emergency lighting system comprising:

a. a plurality of emergency lights;

b. a plurality of emergency power systems, each of the plurality of emergency power systems being electrically connected to a respective one of the plurality of emergency lights through a respective one of a plurality of power switches;

c. a means for monitoring a state of the plurality of emergency power systems;

d. a means for transmitting the monitored state of the plurality of emergency power systems to a gateway radio transceiver; and e. a means for transmitting control information from the gateway radio transceiver to the plurality of emergency power systems.

12. The emergency lighting system of claim 11 wherein the means for monitoring the state of the plurality of emergency power systems comprises a means for load testing the plurality of emergency power systems.

* * * * *